US008938086B2

(12) United States Patent
Zhang et al.

(10) Patent No.: US 8,938,086 B2
(45) Date of Patent: Jan. 20, 2015

(54) MICRO-SPEAKER

(71) Applicants: Xiong Zhang, Shenzhen (CN); San-You Wu, Shenzhen (CN)

(72) Inventors: Xiong Zhang, Shenzhen (CN); San-You Wu, Shenzhen (CN)

(73) Assignees: AAC Acoustic Technologies (Shenzhen) Co., Ltd., Shenzhen (CN); AAC Microtech (Changzhou) Co., Ltd., Changzhou (CN)

( * ) Notice: Subject to any disclaimer, the term of this patent is extended or adjusted under 35 U.S.C. 154(b) by 19 days.

(21) Appl. No.: 13/747,695

(22) Filed: Jan. 23, 2013

(65) Prior Publication Data

US 2013/0259289 A1 Oct. 3, 2013

(30) Foreign Application Priority Data

Mar. 27, 2012 (CN) ..... 2012 2 0119691 U

(51) Int. Cl.
*H04R 11/02* (2006.01)
*H04R 9/02* (2006.01)
*H04R 9/10* (2006.01)

(52) U.S. Cl.
CPC ..... *H04R 9/025* (2013.01); *H04R 9/02* (2013.01); *H04R 9/10* (2013.01); *H04R 2499/11* (2013.01)
USPC ..... 381/409; 381/494; 381/395

(58) Field of Classification Search
USPC ..... 381/409, 394, 395
See application file for complete search history.

(56) References Cited

U.S. PATENT DOCUMENTS 6,476,710 B2 * 11/2002 Togawa et al. ..... 340/384.1
7,010,142 B2 * 3/2006 Kuwabara et al. ..... 381/409

* cited by examiner

*Primary Examiner* — Davetta W Goins
*Assistant Examiner* — Amir Etesam
(74) *Attorney, Agent, or Firm* — Anova Law Group, PLLC

(57) ABSTRACT

A micro-speaker includes a case having a cavity and a receiving hole, a magnetic circuit unit and a vibrating unit with a voice coil received in the cavity, a pair of needle seats embedded in the case for electrically connecting with the voice coil, a pair of pogo-pins arranged in the receiving hole for electrically connecting with the pair of needle seats. Each of the pogo-pins has a barrel unit, a first protrusion and a second protrusion extending from an outer surface of the barrel unit, at least one plunger extending from the barrel unit and projecting out of the receiving hole, a receiving space formed between the first protrusion and the second protrusion. A third protrusion extends from an inner surface of the receiving hole and accommodated in the receiving space for fixing the pogo-pin in the corresponding receiving hole.

5 Claims, 3 Drawing Sheets

MICRO-SPEAKER

FIELD OF THE INVENTION

The present disclosure relates to the art of speakers and, particularly to a speaker having electric terminals for converting electrical signals including audio information to audible sounds.

DESCRIPTION OF RELATED ART

With the rapid development of technologies, the design of electronic devices, such as cellular phones, PDAs (personal digital assistants), and so on, is being driven by the marketplace towards providing more and more multimedia functions. Recently, as the micro-speakers are becoming smaller in size and diversified in function, circuit boards are widely used in the micro-speakers which are required to have high circuit density and reliability.

Usually, in order to reduce the size and ensure the sound output quality of the micro-speaker, surface mounted technology (SMT) is widely used in packaging two ends of a voice coil of the micro-speaker onto the corresponding conductive pads of the circuit board. When assembling the voice coil with the circuit board by SMT, a solder paste is firstly applied to be heated and then applied to the conductive pads of the circuit board by screen printing or stencil printing. Then the two ends of the voice coil are placed on the top of the solder paste. Finally, the solder paste is heated to reflow the ends of the voice coil and the conductive pads of the circuit board, by which the electrical connection between the voice coil and the circuit board is established.

However, during the solder reflow process, additional warping of the circuit board may occur because lack of symmetry heating, and the ends of the voice coil can not accurately solder onto the conductive pads of the circuit board, resulting in defective electrical connection between the conductive pads of the circuit board and the corresponding ends of the voice coil. Thus, the sound output quality of the micro-speaker may be adversely affected.

Alternatively, a metal terminal is used to electrically connect with the two ends of the voice coil. However, after long use of the speaker, a contact area of the metal terminal would be easily oxidized because of constant friction with an external circuit, which directly leads the lifespan of the micro-speaker to be shortened.

Therefore, it is desirable to provide an improved speaker which can overcome the above-mentioned problems.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EMBODIMENT

A micro-speaker in accordance with an exemplary embodiment of the present invention is used for converting audio electrical signals to audible sounds. The speaker includes a case with a sound hole, a magnetic circuit including at least a magnetic gap, at least a vibrating unit corresponding to the magnetic gap, at least a pair of welding pads embedded in the case to electrically connect with the vibrating unit for conducting electrical signals to the vibrating units.

Figure 1:
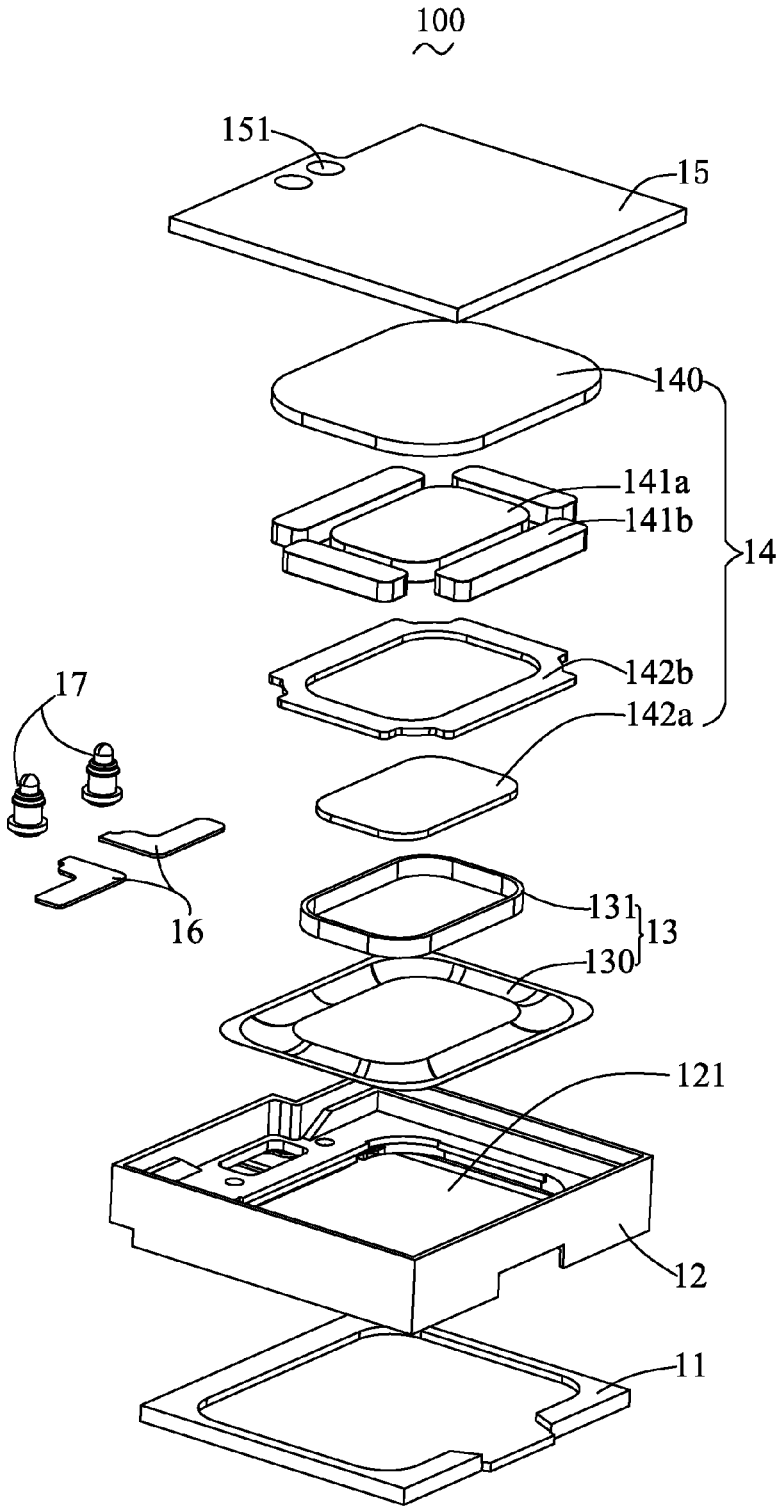
FIG. 1 is an isometric exploded view of a micro-speaker in accordance with an exemplary embodiment of the present invention.
Figure 2:
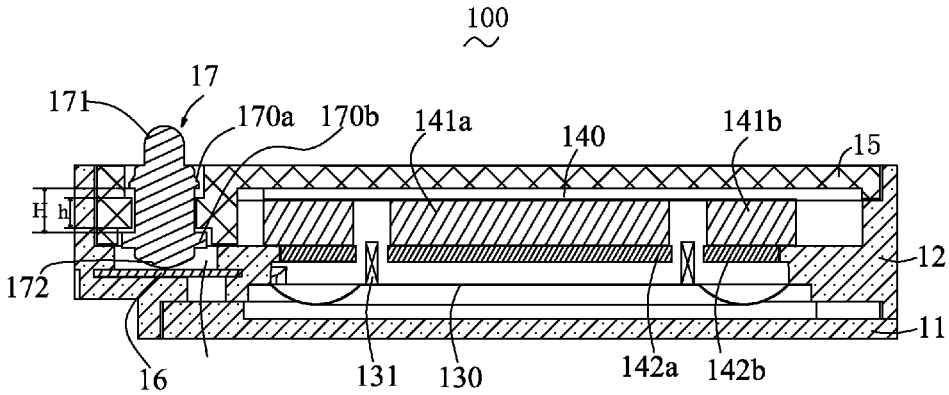
FIG. 2 is a cross-sectional view of the micro-speaker in FIG. 1.

Referring to FIGS. 1 and 2, a micro-speaker 100, in accordance with an exemplary embodiment of the present disclosure, includes a magnetic circuit unit 14, a vibrating unit 13, a case including a front cover 11, a frame 12 and a rear case 15. The case forms a cavity for accommodating the magnetic circuit unit 14 and the vibrating unit 13 therein. The speaker 100 further includes a pair of needle seats 16 embedded in the frame 12 for electrically connecting with a voice coil 131 of the vibrating unit 13. In addition, the speaker 100 includes a pair of pins 17 corresponding to the pair of needle seats 16 for electrical connecting an external circuit via the pair of needle seats 16. The pair of needle seats is made from metal material.

The frame 12 forms a receiving cavity 121 corporately with the rear cover 15. The magnetic circuit unit 14 and the vibrating unit 13 are disposed in the receiving cavity 121. In the embodiment, the magnetic circuit unit 14 includes a pole plate 140 mounted on the rear cover 15, a first magnet 141*a* positioned at a central portion of the pole plate 140, a plurality of second magnets 141*b* positioned at a periphery portion of the pole plate 140 and surrounding the first magnet 141*a*. A magnetic gap is formed between the first magnet 141*a* and the second magnets 141*b*. The combination of the pole plate 140, the first magnet 141*a* and the second magnets 141*b* serves as magnetic circuit unit 14. The first and second magnets 141*a*, 141*b* is provided with a first upper plate 142*a* and a second upper plate 142*b* attached to top surfaces thereof, respectively. The second upper plate 142*b* is annular.

The vibrating unit 13 comprises a diaphragm 130 supported by the frame 12, and a voice coil 131 connected directly or indirectly with a lower surface of the diaphragm 130 and actuated by the magnetic field of the magnetic circuit unit 14.

Figure 3:
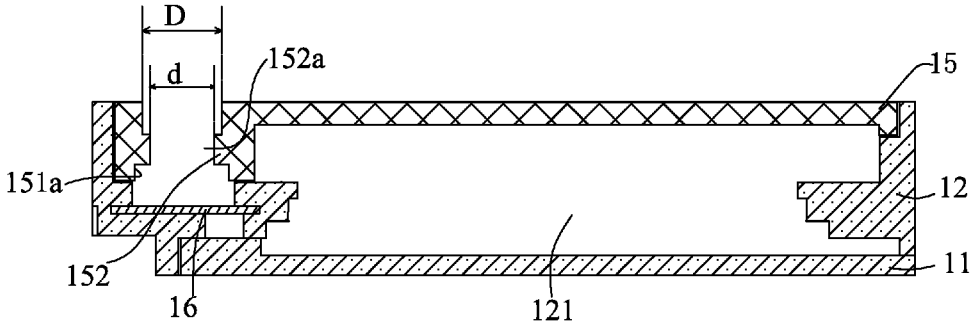
FIG. 3 is a cross-sectional view of a case of the micro-speaker in FIG. 1.
Figure 4:
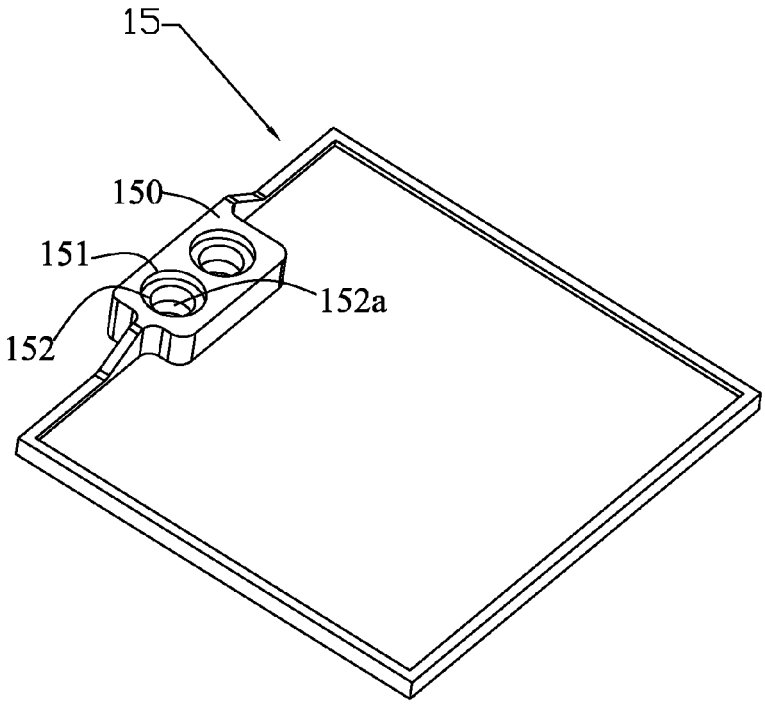
FIG. 4 is an isometric view of a cover of the micro-speaker in FIG. 1.
Figure 5:
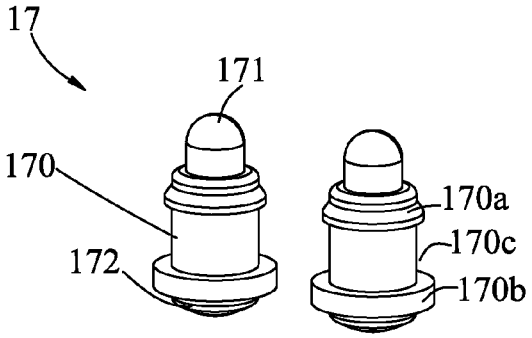
FIG. 5 is an isometric view of a pin of the micro-speaker in FIG. 1.

Referring to FIGS. 3-5, each of the pins 17 includes a barrel unit 170, a first plunger 171 and a second plunger 172 extending from two ends of the barrel unit 170, respectively. Typically, the first plunger 171 and the second plunger 172 are elastic stretch in the barrel unit 170 by a spring in the interior of the barrel unit 170 while the spring compress or expand. In the present embodiment, the barrel unit 170 further defines a first protrusion 170*a* and a second protrusion 170*b* extending from an outer surface of the barrel unit 170. The first protrusion 170*a* and the second protrusion 170*b* are torus-shaped in cross section. The diameter of the first protrusion 170*a* and second protrusion 170*b* is greater than a diameter of the body of barrel unit 170 Thus, a receiving space 170*c* is formed between the first protrusion 170*a* and the second protrusion

170*b*. In alternative embodiments, the pair of pins has at least one plunger. Each of the bottoms of the pins contacts with the corresponding needle seat. The rear cover 15 includes a holder 150 defining a pair of receiving holes 151 corresponding to the pair of pins 17. The holder 150 includes a third protrusion 152 extending from an inner surface 151*a* of the receiving holes 151 accommodated in the receiving space 170*c*. The third protrusion 152 forms a circular aperture 152*a* corresponding to the configuration of the barrel unit 170 of the pin 17. Accordingly, a diameter d of the aperture 152*a* is smaller than a diameter D of the receiving hole 151.

Referring back to FIG. 2, while assembled, the two pins accordingly pass through the receiving holes 151, with one end of each pin contacting the corresponding needle seat 16 to electrically connect with the voice coil 131, and the other end of each pin projecting out of the receiving hole 151 to electrically connect with the external circuit. Meanwhile, the third protrusion 152 is at least partially disposed in the receiving space 170*c* for fixing the corresponding pin the receiving hole 151. In the present embodiment, the second plunger 172 elastically contacts a surface of the needle seat 16. Diameters of the first protrusion 170*a* and the second protrusion 170*b* are both greater than a diameter of the aperture 152*a*. A thickness h of the third protrusion 152 is smaller than or equal to a thickness H of the receiving space 170*c* along a direction parallel to the length of the barrel unit 170.

While the external circuit contacts with the first plunger 171 of the pin, the first plunger 171 is compressed enough to make the second plunger 172 contact with the corresponding needle seat 16 firmly. In addition to saving space, the use of a pin also has advantages of easy assembly, long life cycle, and lower cost.

While the present invention has been described with reference to a specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. A micro-speaker comprising:

a case defining a receiving cavity, and a receiving hole;

a magnetic circuit unit and a vibrating unit with a voice coil received in the cavity;

a pair of needle seats embedded in the case electrically connected with the voice coil;

a pair of pins respectively arranged in the receiving holes for electrically connecting with the pair of needle seats;

each of the pins including a barrel unit, a first plunger and a second plunger respectively extending from two ends of the barrel unit, the first plunger projecting out of the receiving hole, the second plunger elastically contacting the needle seat; and wherein the barrel unit includes a first protrusion and a second protrusion extending from an outer surface of the barrel unit, a receiving space formed between the first protrusion and the second protrusion;

a third protrusion extends from an inner surface of the receiving hole and forms a circular aperture corresponding to the configuration of the barrel unit of the pins for fixing the pins;

the first protrusion and the second protrusion are torus-shaped in cross section, a diameter of the first protrusion and a diameter of the second protrusion are greater than a diameter of the aperture of the third protrusion.

2. The micro-speaker as claimed in claim 1, wherein a thickness of the third protrusion is smaller than or equal to a thickness of the receiving space along a direction parallel to the length of the barrel unit.

3. The micro-speaker as claimed in claim 2, wherein the case defines a frame and a rear cover engaged with the frame.

4. The micro-speaker as claimed in claim 3, wherein the rear cover further includes a holder, and the receiving hole is provided in the holder.

5. The micro-speaker as claimed in claim 4, wherein the pair of needle seats is embedded in the frame.

* * * * *